US007373887B2

(12) United States Patent
Jackson

(10) Patent No.: US 7,373,887 B2
(45) Date of Patent: May 20, 2008

(54) EXPANDING PROJECTILE

(76) Inventor: Jason Stewart Jackson, 1364 Gulfport Run, Grayson, GA (US) 30017

( * ) Notice: Subject to any disclaimer, the term of this patent is extended or adjusted under 35 U.S.C. 154(b) by 0 days.

(21) Appl. No.: 11/480,694

(22) Filed: Jul. 1, 2006

(65) Prior Publication Data

US 2008/0000378 A1 Jan. 3, 2008

(51) Int. Cl.
*F42B 30/02* (2006.01)
*F42B 12/74* (2006.01)
*F42B 12/34* (2006.01)

(52) U.S. Cl. ..... 102/517; 102/510

(58) Field of Classification Search ..... 102/506, 102/507, 508, 509, 510, 517, 518, 501, 513, 102/514, 515, 516
See application file for complete search history.

(56) References Cited

U.S. PATENT DOCUMENTS

| | | | | |
|---|---|---|---|---|
| 843,017 | A | | 2/1907 | Hoxie |
| 896,021 | A | | 8/1908 | Hoxie |
| 1,004,510 | A | | 9/1911 | Watson |
| 1,094,395 | A | | 4/1914 | Kampen |
| 1,155,901 | A | | 10/1915 | Duncan |
| 1,493,614 | A | | 5/1924 | Dickerman |
| 1,512,026 | A | * | 10/1924 | Holden et al. ..... 102/509 |
| 1,833,645 | A | | 11/1931 | Hartz |
| 3,429,263 | A | | 2/1969 | Snyder |
| 3,911,820 | A | | 10/1975 | Canon |
| 3,948,325 | A | | 4/1976 | Winston |
| 3,972,286 | A | | 8/1976 | Canon |
| 3,983,817 | A | | 10/1976 | Tucker |
| 4,193,348 | A | | 3/1980 | Halverson |
| 4,245,557 | A | | 1/1981 | Knappworst |
| 4,352,225 | A | | 10/1982 | Schreiber |
| 4,417,521 | A | | 11/1983 | Dahlitz |
| 4,419,936 | A | * | 12/1983 | Coates et al. ..... 102/364 |
| 4,448,106 | A | * | 5/1984 | Knapp ..... 89/1.11 |
| 4,550,662 | A | | 11/1985 | Burczynski |
| 4,655,140 | A | | 4/1987 | Schirneker |
| 4,665,827 | A | | 5/1987 | Ellis, II |
| 4,742,774 | A | | 5/1988 | Flatau |
| 4,776,279 | A | | 10/1988 | Pejsa |
| 4,836,110 | A | | 6/1989 | Burczynski |
| 4,882,822 | A | | 11/1989 | Burczynski |
| 4,947,755 | A | | 8/1990 | Burczynski |
| 5,086,703 | A | | 2/1992 | Klein |
| 5,149,913 | A | | 9/1992 | Arakaki |
| 5,185,495 | A | | 2/1993 | Petrovich |
| 5,187,325 | A | | 2/1993 | Garvison |
| 5,208,424 | A | | 5/1993 | Schluckebier |
| 5,304,331 | A | | 4/1994 | Leonard |

(Continued)

OTHER PUBLICATIONS

Kurchan and Sellitto, "Shear-thickening and the glass transition", PMMH-ESPCI, Paris, 2006.

(Continued)

*Primary Examiner*—James S Bergin

(57) ABSTRACT

A projectile comprising a body having a channel, one or more recesses in the channel, a plunger in the channel, and a fluid in the channel is provided. When the projectile impacts a target, the plunger is driven down the channel, exerting a force on the fluid. The fluid, in turn, exerts fluidic pressure within the recesses, promoting rapid yet predictable expansion of the projectile. Another embodiment of the present invention provides a projectile utilizing a non-Newtonian fluid to optimize expansion of the projectile upon impacting a target.

11 Claims, 3 Drawing Sheets

U.S. PATENT DOCUMENTS

| | | | | |
|---|---|---|---|---|
| 5,349,907 | A | 9/1994 | Petrovich | |
| 5,385,101 | A | 1/1995 | Corzine | |
| 5,417,004 | A | 5/1995 | Krantz | |
| 5,446,987 | A | 9/1995 | Lee | |
| 5,454,325 | A | 10/1995 | LeBlanc | |
| 5,565,649 | A * | 10/1996 | Tougeron et al. | 102/502 |
| 5,760,329 | A | 6/1998 | Baum | |
| 5,763,819 | A | 6/1998 | Huffman | |
| 6,090,178 | A | 7/2000 | Benini | |
| 6,176,186 | B1 | 1/2001 | Engel | |
| 6,178,890 | B1 | 1/2001 | Burczynski | |
| 6,213,022 | B1 | 4/2001 | Pullum | |
| 6,263,798 | B1 | 7/2001 | Benini | |
| 6,305,292 | B1 | 10/2001 | Burczynski | |
| 6,405,654 | B1 | 6/2002 | Smith | |
| 6,526,893 | B2 | 3/2003 | May | |
| 6,530,328 | B2 | 3/2003 | Burczynski | |
| 6,553,913 | B1 | 4/2003 | Wardlaw | |
| 6,581,522 | B1 | 6/2003 | Julien | |
| 6,619,211 | B1 | 9/2003 | Haeselich | |
| 6,675,718 | B1 | 1/2004 | Parker | |
| 6,772,695 | B2 | 8/2004 | Kellner | |
| 6,772,696 | B2 | 8/2004 | Kellner | |
| 6,789,484 | B2 | 9/2004 | Kellner | |
| 6,792,869 | B2 | 9/2004 | Pi | |
| 6,805,057 | B2 | 10/2004 | Carr | |
| 6,959,648 | B2 | 11/2005 | Piela | |
| 6,997,110 | B2 | 2/2006 | Rastegar | |
| 7,004,074 | B2 | 2/2006 | Stratum | |
| 7,226,878 | B2 | 6/2007 | Wagner | |
| 2003/0089264 | A1 | 5/2003 | Eberhart | |
| 2003/0167956 | A1 | 9/2003 | Kellner | |
| 2004/0003747 | A1 | 1/2004 | Hietanen | |
| 2005/0038406 | A1 * | 2/2005 | Epstein et al. | 604/500 |
| 2005/0126422 | A1 | 6/2005 | Lamm | |
| 2006/0040576 | A1 | 2/2006 | Citterio | |
| 2006/0234572 | A1 | 10/2006 | Wagner | |
| 2007/0079721 | A1 * | 4/2007 | Webb | 102/506 |

OTHER PUBLICATIONS

Rockwood CommuniCLAY, "Laponite®—Performance-focused attributes in rheology and specialty film forming applications", vol. 1, Issue 3, Jun. 21, 2001.

Yuntao Hu, S. Q. Wang, and A. M. Jamieson, "Rheological and flow birefringence studies of a shear-thickening complex fluid-A surfactant model system", The Society of Rheology, Inc., J. Rheology 37(3), May/Jun. 1993.

R. Shankar Subramanian, "Non-Newtonian Flows", 2002.

Wetzel and Wagner, "Novel Flexible Body Armor Utilizing Shear Thickening Fluid (STF) Composites", 14th International Conference on Composite Materials, San Diego, CA, Jul. 14, 2003.

"The Cambridge Polymer Group Silly Putty™ "Egg"", Cambridge Polymer Group, 2002.

* cited by examiner

EXPANDING PROJECTILE

FIELD OF THE INVENTION

The present invention relates to projectiles, and more specifically to expanding projectiles.

BACKGROUND OF THE INVENTION

Expanding projectiles or bullets as known in the art have several advantages over bullets which are not designed to promote expansion, such as "full metal jacket" or "round nose" bullets. For example, when an expanding bullet travels through a target, it can expand, transferring its kinetic energy to the target. Since an expanding bullet can transfer more of its kinetic energy to the target than can a round-nose bullet, an expanding bullet is less likely to exit the target and cause undesired damage. Accordingly, expanding bullets are useful in military, law enforcement, and hunting applications.

Hollow-point bullets are expanding bullets that contain a cavity or "hollow-point" at the front of the bullet. Upon striking a target, the hollow point fills with material from the target, in effect creating a "wedge" or "penetrater" out of the target material. As the hollow-point bullet travels through the target, the target material is forcefully driven into the hollow point, expanding the front of the bullet. In this manner, a hollow-point bullet with sufficient kinetic energy can expand well beyond its original diameter. Further, the loss of kinetic energy due to expansion slows the velocity of the hollow-point bullet, making it less likely that it will exit the target and cause unintentional damage. At a sufficiently high velocity a hollow-point bullet may break into two or more pieces, or fragment, while it is traveling through the target, transferring a large portion of its kinetic energy to the target while further reducing the likelihood of unintentional harm.

Hollow-point bullets have several drawbacks. If bullet velocity is not optimal, then the front of the bullet may only slightly expand, or not expand at all. Hollow-point bullets often fail to expand when the hollow point becomes clogged with certain types of target material, such as heavy clothing. Often, the forward part of a hollow point may expand slightly and then be sheared off, leaving a large cylindrical projectile to travel through and exit the target, transferring minimal kinetic energy to the target and increasing the likelihood of unintentional harm.

To promote bullet expansion, some projectiles utilize a wedge-like solid "ballistic tip" or "penetrater" at the front end of the bullet. Upon striking a target, the penetrater is driven into the bullet, causing the front of the bullet to expand. At sufficiently high velocities the penetrater of a ballistic-tip bullet may be driven far enough within the bullet to cause fragmentation, reducing the chance for unintentional harm. However, if bullet velocity is not optimal, then the front of the bullet may only slightly expand, or not expand at all. Often, the forward part of a ballistic-tip bullet may expand slightly and then be sheared off, leaving a large cylindrical projectile to travel through and exit the target, transferring minimal kinetic energy to the target and increasing the probability of unintentional harm. Under actual shooting conditions, bullet velocity at the target is often not high enough to cause adequate expansion.

Some projectiles in the art use a cylindrical fluid-filled cavity to exert a radial expanding force. Fluid-filled bullets offer several advantages over hollow-point and ballistic-tip bullets. First, there is no hollow point to clog or malfunction as in a hollow-point bullet. Second, fluid-filled bullets can expand more rapidly than either hollow-point or ballistic-tip bullets. Fluid-filled bullets can offer greater expansion at a given velocity than either a hollow-point or a ballistic-tip bullet.

U.S. Pat. No. 5,349,907 to Petrovich discloses a projectile having a cylindrical cavity containing a fluid and a shaft at the front of the cavity. Upon impact, the shaft is driven into the fluid, exerting a radial expanding force on the projectile. U.S. Pat. No. 3,429,263 to Snyder discloses a plastic bullet for dispensing paint onto the surface of a target, with the bullet carrying the paint in a tubular cavity. U.S. Pat. No. 6,675,718 to Parker teaches a method for making a fluid-filled projectile by first assembling a fluid-filled cylinder or capsule, and then inserting the cylinder into a hollow cavity of a bullet.

Despite the potential advantages of fluid-filled projectiles as taught by the prior art, they have had extremely limited to no commercial success. A primary reason for the lack of success is the fact that prior art fluid-filled projectiles exhibit unpredictable and uncontrolled expansion on a round-per-round basis. Predictable expansion is a primary factor when the military, law enforcement agencies, or hunters choose which bullet they are going to use. Accordingly, the military, law enforcement agencies, and hunters have not adopted fluid-filled bullets.

Thus, there is a need in the art for a fluid-filled projectile that expands in a predictable manner. Such a projectile would be useful in numerous military, law enforcement, and hunting applications.

SUMMARY OF THE INVENTION

In one embodiment of the present invention a projectile comprising a body having a channel, one or more recesses in the channel, a plunger in the channel, and a fluid in the channel is provided. Each recess has one or more surfaces. The recesses can be designed to optimize expansion of the projectile when a fluid exerts a pressure from within the projectile. Upon impacting a target, the plunger is driven down the channel, exerting a force on the fluid. The fluid, in turn, exerts pressure within each recess. The one or more recesses and their surfaces can be designed to achieve an optimal and controlled expansion depending on a variety of factors, including projectile caliber, weight, material, velocity, target characteristics, and fluid volume. In one embodiment of the present invention the channel does not have a uniform diameter. A recess can be of any size, shape, position, and orientation in the projectile, such as a horizontal groove. In another embodiment a recess can be a longitudinal groove. In further embodiments of the present invention any combination of horizontal grooves, longitudinal grooves, or shapes of various sizes can be used. The fluid can be Newtonian or non-Newtonian.

In a further embodiment of the present invention the channel contains a fluid as well as a compressible material such as a gas or a solid. The compressible material can be used to delay expansion of the projectile. The bottom of the plunger can contain a recess containing a fluid or a compressible material in further embodiments of the present invention.

Unless otherwise expressly stated, it is in no way intended that any method or embodiment set forth herein be construed as requiring that its steps be performed in a specific order. Accordingly, where a method or system claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of embodiments described in the specification.

BRIEF DESCRIPTION OF THE DRAWINGS

The accompanying drawings, which are incorporated in and constitute part of this specification, illustrate embodiments of the invention, and together with the description, serve to explain the principles of the invention. The embodiments described in the drawings and specification in no way limit or define the scope of the present invention.

DETAILED DESCRIPTION OF THE INVENTION

The present invention has been illustrated in relation to embodiments which are intended in all respects to be illustrative rather than restrictive. Those skilled in the art will realize that the present invention is capable of many modifications and variations without departing from the scope of the invention.

Figure 1:
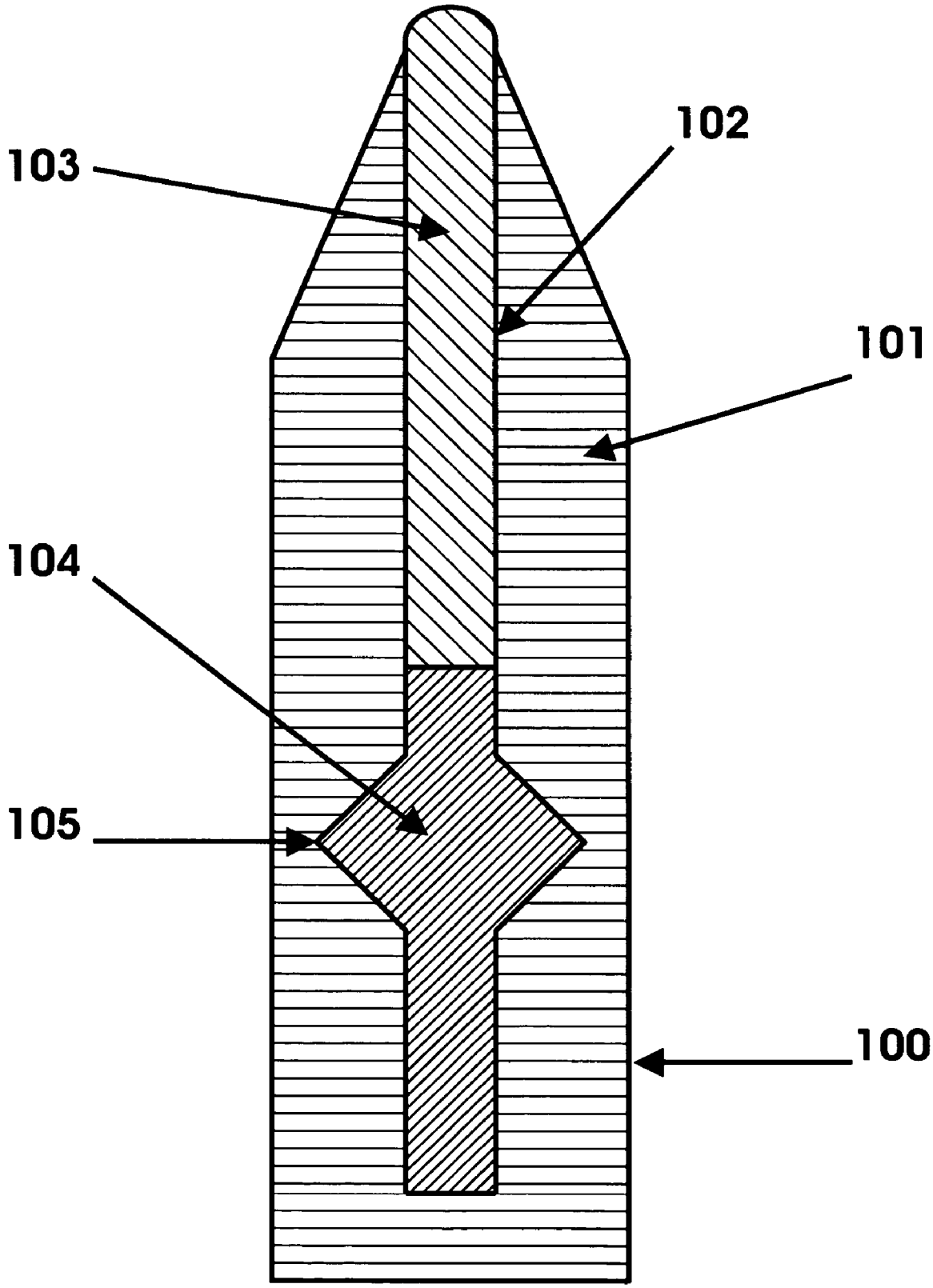
FIG. 1 is a sectional side view of one embodiment of the present invention.

One embodiment of the present invention provides a fluid-filled expanding projectile and is shown in FIG. 1. In the embodiment of FIG. 1, a projectile 100 is provided having a body 101 and a channel 102. The channel 102 has a recess 105 and contains a fluid 104. Upon impacting a target, the plunger 103 is driven down the channel 102, exerting a force on the fluid 104. Pascal's principle states that any change in pressure applied at any given point on a confined and incompressible fluid is transmitted equally throughout the fluid. Thus, a force applied by the plunger 103 is converted into a fluidic pressure exerted equally and normal to every surface of the channel 102 in contact with the fluid 104, including the surfaces of the recess 105. As understood by one of skill in the art, there are flat surfaces and there are curved surfaces. A flat surface is a group of points that are co-planar. A surface normal or "normal" to a flat surface is a three-dimensional vector that is perpendicular to that surface. A normal to a curved surface at a point p on the surface is a vector that is perpendicular to the tangent plane of the surface at p. Since the force exerted on each surface will be normal to the surface, the size, shape, orientation, surface normal, and position of the surface within the projectile can be designed to direct the force in a manner that provides for optimal and predictable expansion of the projectile.

In the embodiment of FIG. 1 the recess 105 is a v-shaped groove parallel to the horizontal axis of the projectile 100. As seen in FIG. 1 the horizontal recess 105 includes an upper surface and a lower surface joined at an apex. When the plunger 103 travels down the channel 102 and exerts a force on the fluid 104, that force, in turn, is in turn exerted at every point in the channel 102 which is in contact with the fluid 104, including at the upper and lower surfaces of the recess 105. The fluid will exert a force normal to the upper surface of the recess 105, such that the force acting on the upper surface is directed at a first angle above the horizontal axis of the projectile. The fluid will also exert a force normal to the lower surface of the recess 105, such that the force acting on the lower surface is directed at a second angle below the horizontal axis of the projectile. As understood by one of skill in the art, the forces acting on the upper surface and the forces acting on the lower surface have components acting in different directions along the long axis of the projectile, focusing a disruptive force at the apex of the upper and lower surfaces. Accordingly, the projectile 100 of the current embodiment can rapidly expand or separate at one or more points around the projectile 100 near the recess 105. Thus, the projectile 100 shown in the embodiment of FIG. 1 overcomes the deficiencies in the prior art by providing a fluid-filled projectile that provides rapid and predictable expansion by using a recess to direct an internal fluidic pressure.

The projectile body or jacket of any embodiment of the present invention can be composed of any suitable substance, including metals such as lead, tin, copper, iron, aluminum, and their alloys. The projectile can be formed of one material, or the projectile can comprise multiple materials, such as a lead-alloy body and a copper jacket. The plunger of any embodiment of the present invention can be composed of any suitable material, including metals, plastics, ceramics, or composite materials. Any suitable fluid may be used in embodiments of the present invention, including liquid polymers, lubricating oils, vegetable oils, water, or silicone. The viscosity of the fluid can be chosen to achieve optimal expansion of the projectile.

A recess in embodiments of the present invention can have any size and shape, including spherical, semi-spherical, curved, flat, rectangular, triangular, elliptical, conical, cylindrical, polygonal, or any combination thereof. A recess can be negative, thereby increasing the total closed volume of the channel below the plunger. A recess can also be positive in any embodiment of the present invention, thereby decreasing the total closed volume of the channel below the plunger. In further embodiments of the present invention, the channel may contain one or more negative recesses as well as one or more positive recesses.

In any embodiment of the present invention the size, shape, position, orientation, and normal of a recess and one or more of its surfaces can be chosen to achieve optimal expansion depending on a variety of factors, including projectile characteristics (such as caliber, weight, material, channel characteristics, and velocity), fluid characteristics (such as volume, viscosity, pressure, and expected response to a force), the characteristics of one or more other recesses, and target characteristics. For example, a recess can be a horizontal groove 105 in one embodiment of the present invention. A recess can also be a longitudinal groove. In further embodiments of the present invention a horizontal groove 105 can be combined with a recess of another shape or size. The channel in any embodiment of the present invention can be of any size and shape, including curved, cylindrical, rectangular, spherical, semi-spherical, conical, polygonal, or any combination thereof. The channel in any embodiment can be shaped and sized to achieve optimal expansion depending on a variety of factors, including projectile characteristics (such as caliber, weight, material, and velocity), fluid characteristics (such as volume, viscosity, pressure, and expected response to a force), the characteristics of one or more recesses, and target characteristics.

Newtonian and non-Newtonian fluids can be used or combined in any embodiment of the present invention. As understood by one of skill in the art, a non-Newtonian fluid is a fluid in which the viscosity can change with the applied strain rate or with the duration of stress. There are fluids having various degrees and types of non-Newtonian behavior and any of these fluids can be used in embodiments of the present invention, including fluids with time-dependent viscosity, viscoelastic fluids, power-law fluids, and plastic solids.

As understood by one of skill in the art, time-dependent viscosity fluids can exhibit either thixotropic or rheopectic behavior. In a fluid exhibiting thixotropic behavior the apparent viscosity decreases with the duration of stress. In a fluid exhibiting rheopectic behavior the apparent viscosity increases with the duration of stress.

Viscoelastic fluids as understood by one of skill in the art have both viscous and elastic properties, and can be categorized as anelastic, kelvin material, oldroyd-B fluid, or Maxwell material.

As understood by one of skill in the art, in power-law fluids the apparent viscosity changes with the rate of shear, and can exhibit dilatant or pseudo-plastic behavior. In a pseudo-plastic or "shear thinning" fluid the apparent viscosity reduces with the rate of shear. In a dilatant or "shear thickening" fluid the apparent viscosity increases with rate of shear.

Plastic solids can be categorized as yield dilatent, yield pseudo-plastic, Bingham plastic, or perfectly plastic as understood by one of skill in the art. A perfectly plastic material is a material wherein a strain does not result in opposing stress. A yield pseudo-plastic material is a pseudo-plastic above some threshold shear stress, and a yield dilatent is a dilatent above some threshold shear stress.

A fluid-filled projectile containing an appropriate non-Newtonian fluid can act like a solid projectile when it initially strikes the target, enabling the projectile to reach a minimum penetration before substantial expansion. Shortly thereafter, the non-Newtonian fluid can flow like a regular fluid, exerting fluidic pressure on the internal surfaces of the projectile to cause rapid expansion. A Bingham plastic is a material that behaves as a rigid body at low stresses but flows as a viscous fluid at high stress. One embodiment of the present invention provides a fluid-filled projectile containing a Bingham plastic. While the projectile is being stored, carried, or handled, the fluid can act like a solid. This is advantageous for many reasons. For example, such a projectile would not leak fluid, which could limit the effectiveness of the projectile and potentially harm firearm mechanisms. When the projectile initially strikes a target, the fluid is in a rigid form, causing the projectile to act like a solid projectile. When the force exerted on the fluid as a result of the impact reaches a threshold, the fluid begins to flow as a regular fluid and exert a fluidic pressure within the projectile, causing rapid expansion. Such a projectile would be useful in numerous military, law enforcement, and hunting applications where there is a need for a projectile that can penetrate a target and then rapidly expand, transferring a large amount of kinetic energy to the target and reducing the likelihood that the projectile will exit the target.

Figure 2:
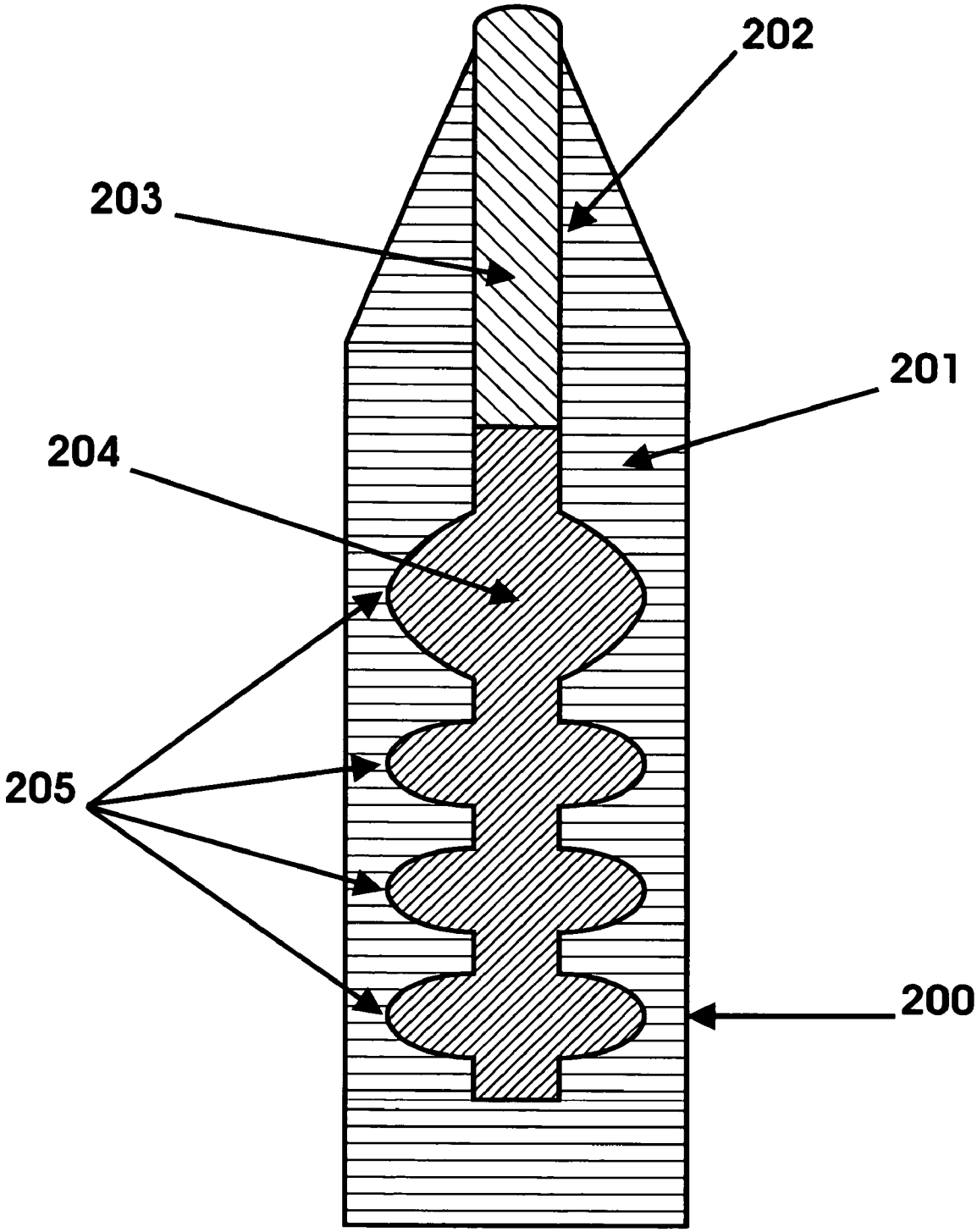
FIG. 2 is a sectional side view of another embodiment of the present invention.
Figure 3:
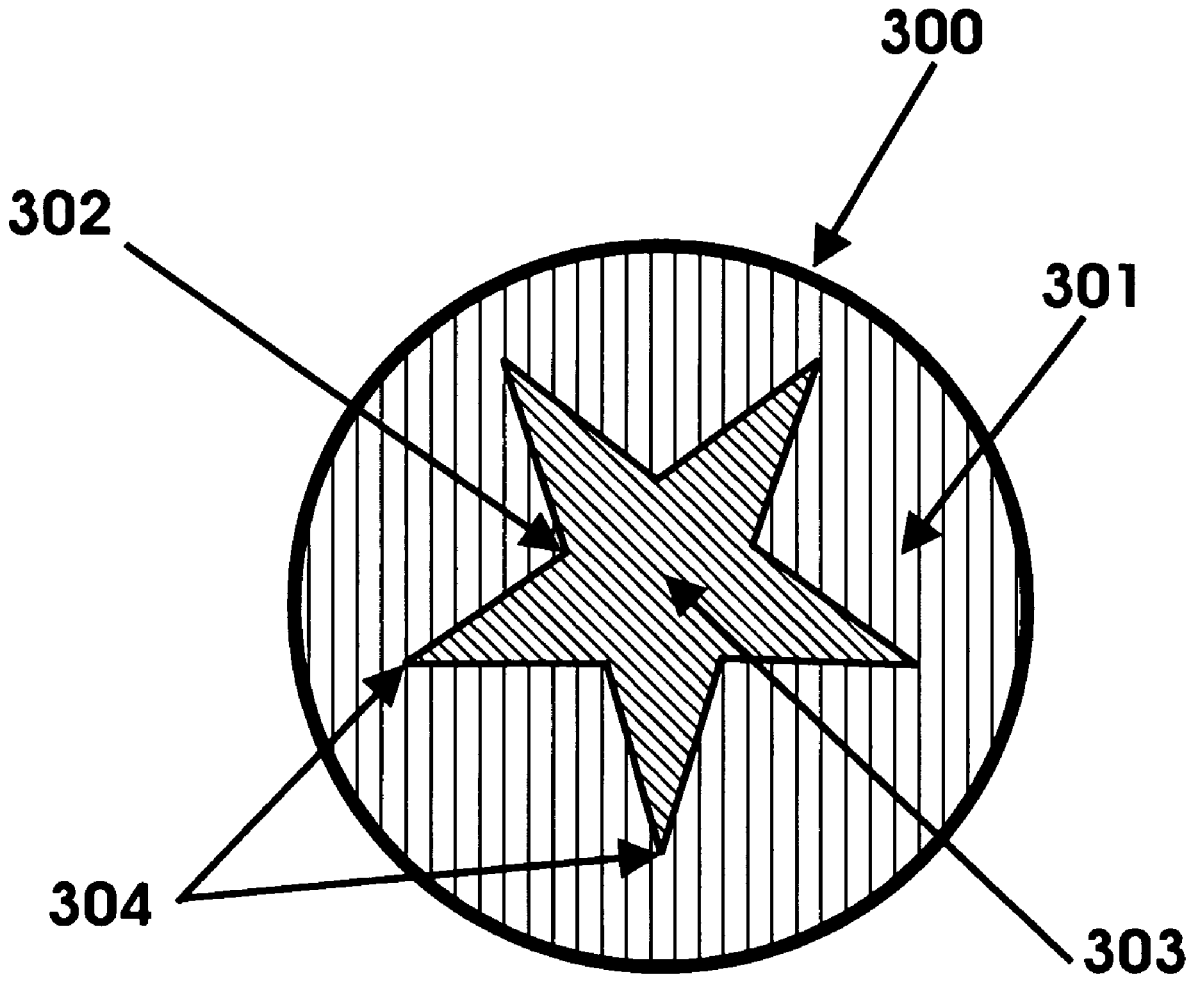
FIG. 3 is a sectional top view of a further embodiment of the present invention.

A projectile with one or more recesses, like the projectiles shown in the embodiments of FIGS. 1, 2, and 3, can contain a non-Newtonian fluid to optimize expansion of the projectile. Further, the projectile of any embodiment of the present invention can be constructed without a plunger in the channel.

Another embodiment of the present invention provides a fluid-filled expanding projectile and is shown in FIG. 2. In the embodiment of FIG. 2, a projectile 200 is provided having a body 201 and a channel 202. The channel 202 has a plurality of recesses 205 and contains a fluid 204. Upon impacting a target, a plunger 203 is driven down the channel 202, exerting a force on the fluid 204. The force applied by the plunger 203 is converted into a fluidic pressure exerted equally and normal to every surface of the channel 202 in contact with the fluid 204, including the surfaces of the recesses 205. The projectile 200 has a plurality of recesses 205, with at least two recesses 205 having a different design. Each of the plurality of recesses 205 can be designed to optimize expansion of the projectile. Thus, the projectile 200 shown in the embodiment of FIG. 2 overcomes the deficiencies in the prior art by providing a fluid-filled projectile that directs internal fluidic pressure to provide rapid yet predictable expansion.

In the embodiment of the invention depicted in FIG. 3, a projectile 300 having a body 301 with a channel 302 is provided. The channel 302 can have one or more longitudinal grooves 304 which can be used in any embodiment of the present invention. The longitudinal grooves 304 can be arranged to optimize expansion of the projectile 300 when a fluid 303 exerts a pressure from within the projectile 300. In further embodiments of the present invention the longitudinal grooves 304 can be combined with one or more recesses of other shapes or sizes, such as a horizontal groove. The one or more other shapes can be chosen to achieve optimal projectile expansion.

In any embodiment of the present invention the channel can contain a fluid as well as a compressible material such as a gas or a solid. The compressible material can allow the plunger to travel down the channel for a predetermined length before exerting a force on the fluid great enough to cause expansion of the projectile. Thus, the compressible material is useful to delay expansion of the projectile until it has traveled a desired distance into the target. The type and amount of the compressible material can be chosen to optimize expansion of the projectile. Further, in various embodiments of the present invention, the bottom of the plunger may contain a recess containing a fluid or a compressible material. The compressible material in the recess of the plunger can also be used to delay expansion of the projectile.

While the invention has been described in detail in connection with specific embodiments, it should be understood that the invention is not limited to the above-disclosed embodiments. Rather, the invention can be modified to incorporate any number of variations, alternations, substitutions, or equivalent arrangements not heretofore described, but which are commensurate with the spirit and scope of the invention. Specific embodiments should be taken as exemplary and not limiting.

I claim:

1. A projectile comprising:

a. a body;

b. a channel located in the body, wherein the channel contains a non-Newtonian fluid comprising at least a shear thickening fluid;

c. a plurality of recesses located in the channel, wherein the plurality of recesses cause expansion of the body by directing a pressure received from the non-Newtonian fluid; and d. a plunger located in the channel, wherein the plunger transmits a force to the non-Newtonian fluid upon striking a target, causing the non-Newtonian fluid to exert the pressure on the plurality of recesses located in the channel, wherein the viscosity of the shear thickening fluid increases with the rate of shear at impact with the target.

2. The projectile of claim 1, wherein the plurality of recesses includes a first recess comprising at least a horizontal groove.

3. The projectile of claim 2, wherein the first recess comprising at least a horizontal groove further comprises at least two surfaces that join at a first apex to focus the pressure on the body.

4. The projectile of claim 1, wherein the plurality of recesses comprises a first recess comprising a first horizontal groove and a second recess comprising a second horizontal groove.

5. The projectile of claim 4, wherein the first recess comprising a first horizontal groove further comprises at least two surfaces that join at a first apex to focus the pressure on the body.

6. The projectile of claim 5, wherein the second recess comprising a second horizontal groove further comprises at least two surfaces that join at a second apex to focus the pressure on the body.

7. The projectile of claim 1, wherein the plurality of recesses includes a first recess comprising at least a vertical groove.

8. The projectile of claim 7, wherein the first recess comprising at least a vertical groove further comprises at least two surfaces that join at a first apex to focus the pressure on the body.

9. The projectile of claim 1, wherein the plurality of recesses comprises a first recess comprising at least a first vertical groove and a second recess comprising at least a second vertical groove.

10. The projectile of claim 9, wherein the first recess comprising at least a first vertical groove further comprises at least two surfaces that join at a first apex to focus the pressure on the body.

11. The projectile of claim 10, wherein the second recess comprising at least a second vertical groove further comprises at least two surfaces that join at a second apex to focus the pressure on the body.

* * * * *